US010161186B1

(12) United States Patent
Long

(10) Patent No.: US 10,161,186 B1
(45) Date of Patent: Dec. 25, 2018

(54) LADDER SECURING DEVICE

(71) Applicant: Robert S. Long, Cape Coral, FL (US)

(72) Inventor: Robert S. Long, Cape Coral, FL (US)

( * ) Notice: Subject to any disclaimer, the term of this patent is extended or adjusted under 35 U.S.C. 154(b) by 0 days.

(21) Appl. No.: 15/644,943

(22) Filed: Jul. 10, 2017

Related U.S. Application Data

(60) Provisional application No. 62/601,471, filed on Mar. 24, 2017, provisional application No. 62/496,655, filed on Oct. 25, 2016, provisional application No. 62/499,435, filed on Jan. 26, 2017.

(51) Int. Cl.
*E06C 7/48* (2006.01)
*E06C 1/04* (2006.01)

(52) U.S. Cl.
CPC ..... *E06C 7/488* (2013.01); *E06C 1/04* (2013.01)

(58) Field of Classification Search
CPC ..... E06C 7/488; E06C 1/04
See application file for complete search history.

(56) References Cited

U.S. PATENT DOCUMENTS 2,868,427 A * 1/1959 Hess ..... E06C 7/42 182/107
3,606,226 A * 9/1971 Bell ..... E06C 1/345 182/206
3,792,756 A 2/1974 Kelly
D272,857 S * 2/1984 Leach ..... D25/68
4,545,460 A 10/1985 Byrd
4,603,756 A * 8/1986 Layher ..... E04G 7/307 182/186.8
4,643,275 A * 2/1987 LeBlanc ..... E06C 7/48 182/107
4,792,016 A * 12/1988 Ingalsbe ..... E06C 1/34 182/107
5,078,231 A * 1/1992 Davis ..... E06C 7/42 182/107
5,361,558 A * 11/1994 Thornton ..... A62B 35/0068 52/698
5,529,145 A 6/1996 Allred
5,603,591 A * 2/1997 McLellan ..... B60P 7/0823 224/318
6,550,577 B1 * 4/2003 Allgire ..... E06C 1/34 182/107
7,380,640 B1 * 6/2008 Kemp ..... E06C 7/50 182/107
7,634,842 B2 * 12/2009 Santisi ..... B62J 7/08 24/131 R
7,854,042 B2 * 12/2010 Richardson ..... B65D 63/10 24/16 R
8,302,927 B2 * 11/2012 Wright ..... A01D 34/001 248/156
9,810,023 B2 * 11/2017 Stewart ..... E06C 7/42
2002/0088668 A1 * 7/2002 Moore ..... E06C 7/48 182/107

(Continued)

*Primary Examiner* — Katherine W Mitchell
*Assistant Examiner* — Candace L Bradford
(74) *Attorney, Agent, or Firm* — Edward M. Livingston, Esq.; Bryan L. Loeffler, Esq.; Livingston Loeffler, P.A.

(57) ABSTRACT

A ladder securing device (10) for securing a ladder (12) to the side of house to prevent the ladder from tipping over while unattended. The ladder securing device has a substantially U-shaped clip (2) that slides under a drip edge (13) and/or under a piece of fascia (14). The clip is then attached to a rung of a ladder using one or more straps (9) extending from the U-shaped clip.

6 Claims, 3 Drawing Sheets

(56) References Cited

U.S. PATENT DOCUMENTS

| | | | | |
|---|---|---|---|---|
| 2004/0055820 | A1 | 3/2004 | Charlton | |
| 2005/0011702 | A1* | 1/2005 | Zeaman | E06C 7/42 182/108 |
| 2006/0054390 | A1 | 3/2006 | Ray | |
| 2010/0116589 | A1* | 5/2010 | Mathieson | E04D 13/076 182/107 |
| 2014/0367197 | A1 | 12/2014 | Mathieson | |
| 2015/0267471 | A1* | 9/2015 | Charlton | E06C 7/486 182/107 |

* cited by examiner

LADDER SECURING DEVICE

CROSS-REFERENCE TO RELATED APPLICATION

This application claims priority to applications 62/601,471 filed on Mar. 24, 2017, 62/496,655 filed on Oct. 25, 2016, and 62/499,435 filed on Jan. 26, 2017. The patent applications identified above are incorporated herein by reference in their entirety to provide continuity of disclosure.

FIELD OF THE INVENTION

This invention relates to ladders and ladder safety devices and more particularly to a device used for securing a ladder to a structure to prevent the ladder from falling over when left unattended.

BACKGROUND OF THE INVENTION

Ladders are commonly used around residential and commercial structures to access upper stories and roofs to perform maintenance or repairs. A common problem with unattended ladders is a tendency for them to tip over. This can occur when the ladder is not properly angled against a building and/or as the result of a strong gust of wind.

When an unattended ladder tips over, it can cause damage to the structure, nearby objects (such as vehicles, outdoor furniture, shrubs and so forth), individuals and/or to the ladder itself. In addition, individuals working on a roof can be left stranded with no way to climb down from the roof.

Therefore, a need exists for a ladder securing device that temporarily secures a ladder to a structure to prevent the ladder from falling or tipping over when left unattended. The relevant prior art includes the following references:

SUMMARY OF THE INVENTION

The primary object of the present invention is to provide a ladder securing device that temporarily secures a ladder to a structure to prevent the ladder from falling or tipping over when left unattended.

The present invention fulfills the above and other objects by providing a device for securing a ladder to the side of house to prevent the ladder from tipping over while unattended. The device has a substantially U-shaped clip that slides under a drip edge and/or under a fascia board. The clip is then attached to a rung of a ladder using one or more straps extending from the U-shaped clip.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
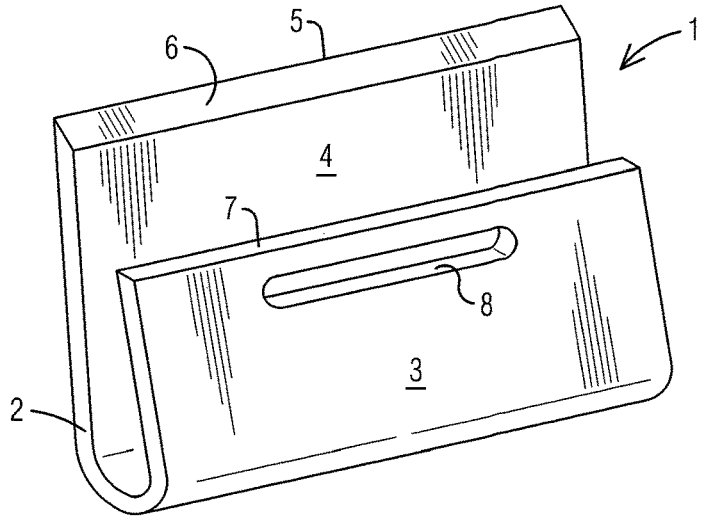
FIG. 1 is a perspective view of a ladder securing device of the present invention used for securing a ladder to a drip edge.

For purposes of describing the preferred embodiment, the terminology used in reference to the numbered accessories in the drawings is as follows:

1. ladder securing device, generally
2. U-shaped clip
3. strap support panel of U-shaped clip
4. securing panel of U-shaped clip
4*a*. first securing panel of U-shaped clip
4*b*. first securing panel of U-shaped clip
5. upper edge of securing panel
6. bevel
7. upper edge of strap support panel
8. horizontal slot
9. strap
10. attachment means
11. hook and loop fastener
12. ladder
13. drip edge
14. fascia
15. extended U-shaped clip
16. bottom panel
17. dual clip With reference to FIGS. 1 and 2, a perspective view of a ladder securing device 1 of the present invention used for securing a ladder 12 to a drip edge 13 and a perspective side view of a ladder securing device 1 of the present invention in use securing a ladder 12 to a drip edge 13, respectively, are illustrated. The ladder securing device 1 of the present invention comprises a substantially U-shaped clip 2 having a strap support panel 3 and a securing panel 4 wherein the strap support panel 3 is angled toward the securing panel 4 to create tension between the strap support panel 3 and the securing panel 4 when an object, such as drip edge, is slid between the strap support panel 3 and the securing panel 4. The strap support panel 3 may be bent over the securing panel 4 to create the U shape, as illustrated herein, or the strap support panel 3 and securing panel 4 may extend upward from a bottom panel 16, as further illustrated in FIGS. 3 and 5. The securing panel 4 preferably comprises an upper edge 5 which has a bevel 6 to allow the securing panel 4 to be inserted into a narrow space located between a drip edge 13 and fascia 14. The strap support panel 3 preferably comprises an upper edge 7 that is lower in height than the upper edge 5 of the securing panel 4 to allow the securing panel 4 to be fully inserted behind a drip edge 13 without being hindered by the strap support panel 3. The strap support panel 3 may be angled, curved or C-shaped, thereby causing the upper edge 7 thereof to angle outward away from the securing panel 4 to make it easier to slide the U-shaped clip 2 over a drip edge. A horizontal slot 8 is located below the upper edge 7 of the strap support panel 3 and is parallel to the upper edge 7 to provide an attachment point for a strap 9. The slot 8 is preferably located above a portion of the strap support panel 3 that makes contact with the securing panel 4 to allow the strap 9 to be adjusted freely after the U-shaped clip 2 has been positioned on a piece of drip edge 13. One or more attachment means 10, such as hook and loop fastener 11 is located on the strap 9 to allow the strap 9 to be looped around a rung of a ladder and then fastened back on itself.

Figure 2:
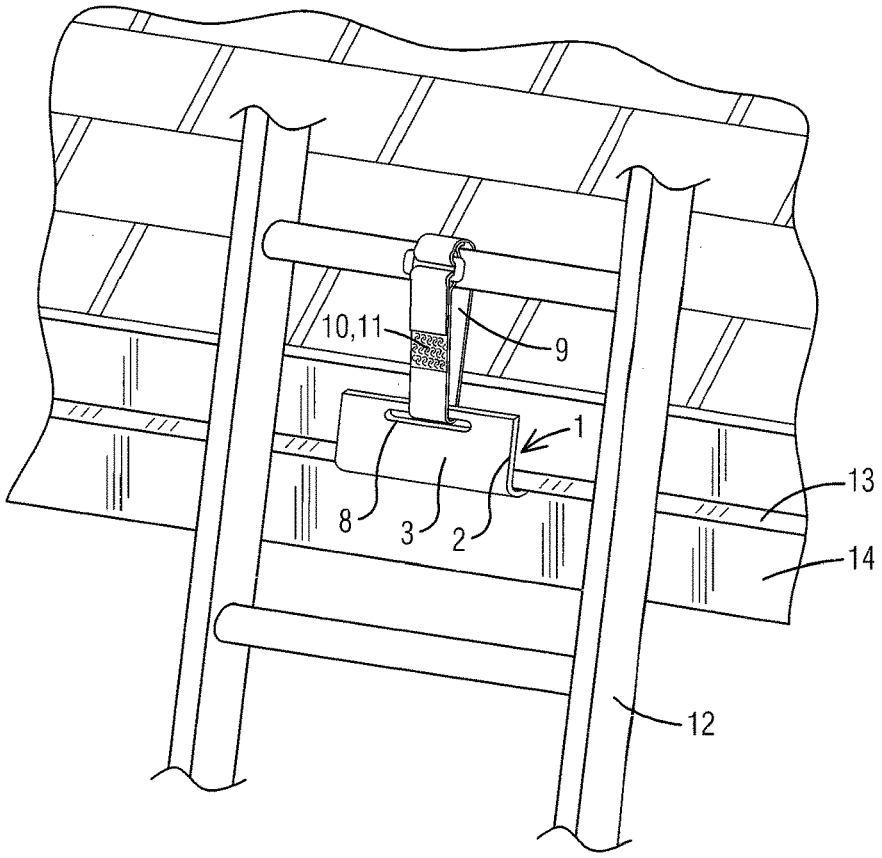
FIG. 2 is a perspective side view of a ladder securing device of the present invention in use securing a ladder to a drip edge.
Figure 3:
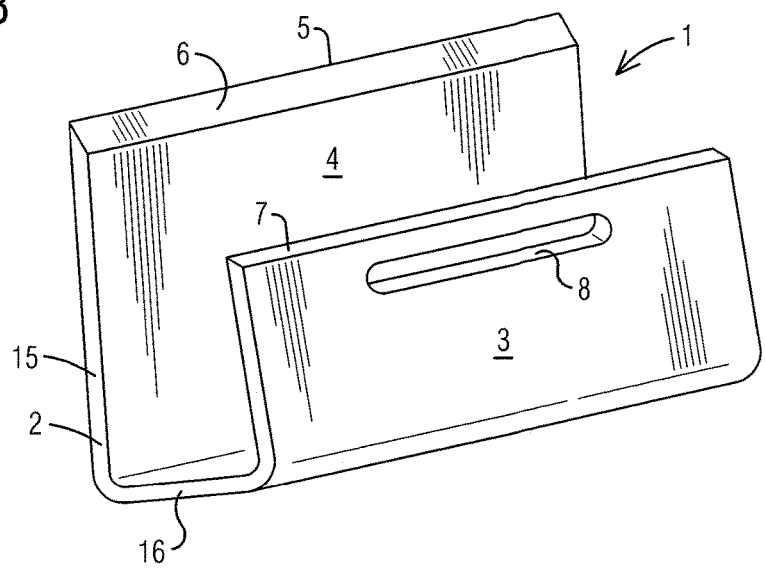
FIG. 3 is a perspective view of a ladder securing device of the present invention having an extended clip used for securing a ladder to fascia.
Figure 4:
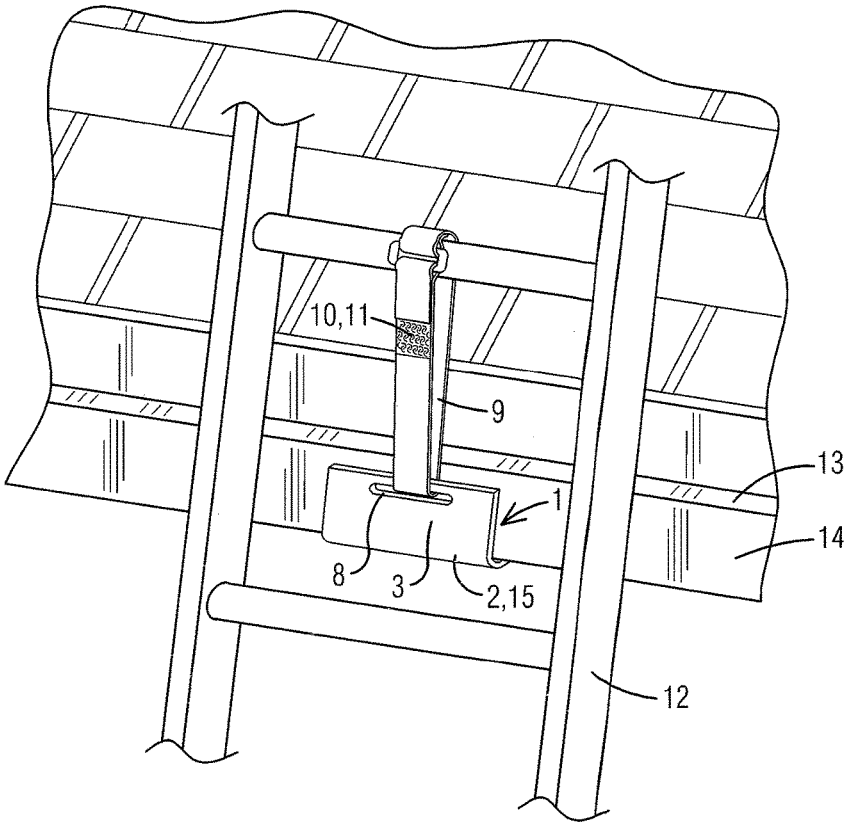
FIG. 4 is a perspective side view of a ladder securing device of the present invention in use securing a ladder to fascia.

With reference to FIGS. 3 and 4, a perspective view of a ladder securing device 1 of the present invention having an extended U-shaped clip 15 used for securing a ladder 12 to fascia 14 and a perspective side view of a ladder securing device 1 of the present invention in use securing a ladder 12 to fascia 14 is illustrated. The ladder securing device 1 of the present invention comprises a substantially U-shaped clip 15 having a strap support panel 3 and a securing panel 4 wherein the strap support panel 3 is angled toward the securing panel 4 to create tension between the strap support panel 3 and the securing panel 4 when an object, such as fascia, is slid between the strap support panel 3 and the securing panel 4. The strap support panel 3 may be bent over the securing panel 4 to create the U shape, as illustrated in FIG. 1, or the strap support panel 3 and securing panel 4 may extend upward from a bottom panel 16, as illustrated herein. The strap support panel 3 preferably comprises an upper edge 7 that is lower in height than the upper edge 5 of the securing panel 4 to allow the securing panel 4 to be fully inserted over a piece of fascia without being hindered by the strap support panel 3. The strap support panel 3 may be angled, curved or C-shaped, thereby causing the upper edge 7 thereof to angle outward away from the securing panel 4 to make it easier to slide the U-shaped clip 2 over a piece of fascia. A horizontal slot 8 is located below the upper edge 7 of the strap support panel 3 and is parallel to the upper edge 7 to provide an attachment point for a strap 9. The slot 8 is preferably located above a portion of the strap support panel 3 that curves inward toward the securing panel 4 to allow the strap 9 to be adjusted freely after the U-shaped clip 2 has been positioned on a piece of fascia. One or more attachment means 10, such as hook and loop fastener 11 is located on the strap 9 to allow the strap 9 to be looped around a rung of a ladder and then fastened back on itself.

Figure 5:
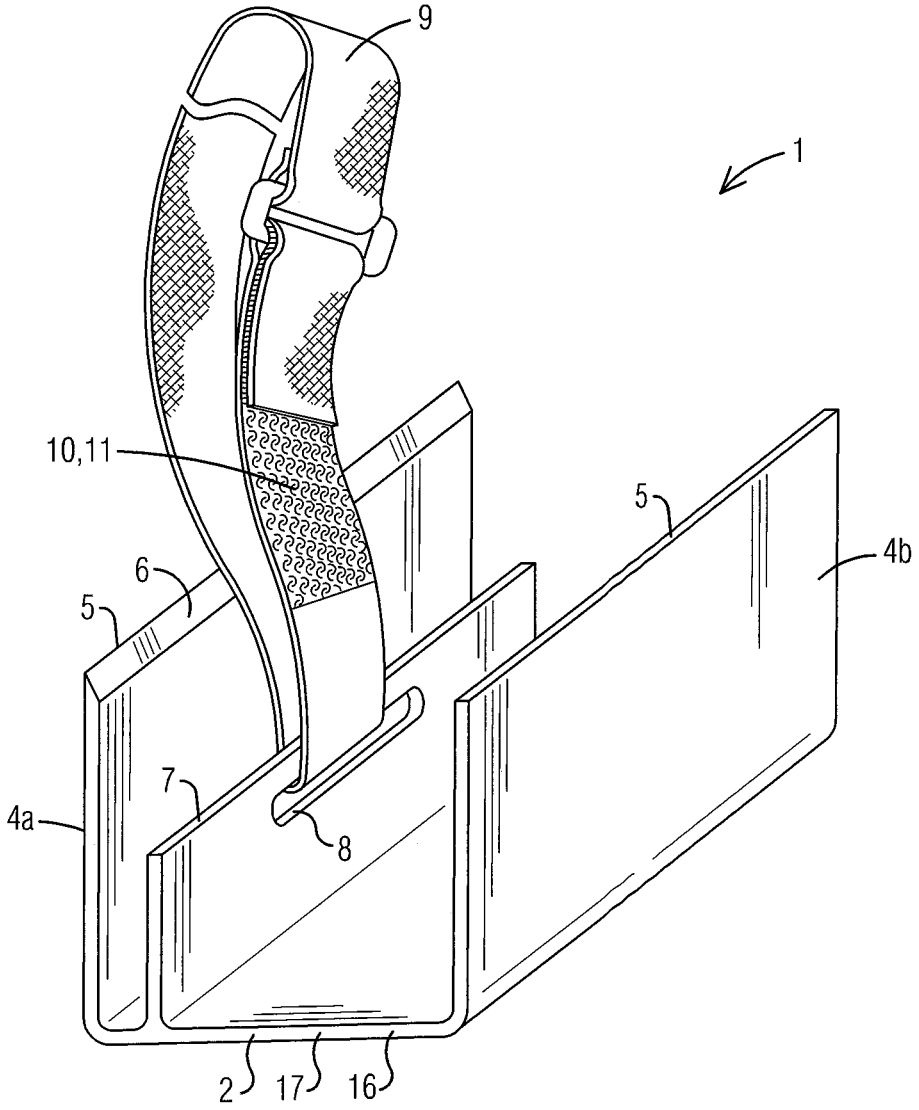
FIG. 5 is a perspective view of a ladder securing device of the present invention having a dual clip used for securing a ladder to a drip edge or to fascia.

With reference to FIG. 5, a perspective view of a ladder securing device 1 of the present invention having a dual clip 17 used for securing a ladder 12 to a drip edge 13 or fascia 14 is illustrated. The ladder securing device 1 of the present invention comprises a substantially U-shaped clip 2 having a bottom panel 16, a strap support panel 3 extending upward from a central portion of the bottom panel 16, a first securing panel 4*a* and a second securing panel 4*b* extending upward from opposing edges of the bottom panel 16 wherein the first securing panel 4*a* and the second securing panel 4*b* are parallel to the strap support panel 3. A distance between the first securing panel 4*a* and the strap support panel 3 is less than a distance between the second securing panel and the strap support panel 3. Therefore, the first securing panel 4*a* may be used to secure the ladder securing device 1 to a drip edge 13 and the second securing panel 4*b* may be used to secure the ladder securing device 1 to fascia 14. The first securing panel 4*a* preferably comprises an upper edge 5 which has a bevel 6 to allow the first securing panel 4*a* to be inserted into a narrow space located between a drip edge 13 and fascia 14. The strap support panel 3 preferably comprises an upper edge 7 that is lower in height than the upper edge 5 of the first securing panel 4*a* and the second securing panel 4*b*. A horizontal slot 8 is located below the upper edge 7 of the strap support panel 3 and is parallel to the upper edge 7 to provide an attachment point for a strap 9. One or more attachment means 10, such as hook and loop fastener 11 is located on the strap 9 to allow the strap 9 to be looped around a rung of a ladder and then fastened back on itself It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A ladder securing device comprising:

a substantially U-shaped clip having a strap support panel and a securing panel located parallel to each other;

said strap support panel having an upper edge;

said securing panel having an upper edge;

an elongated slot located on and passing through the strap support panel below upper edge of the strap support panel and being parallel to the upper edge of the strap support panel to provide an attachment point for a strap;

said strap looping through said elongated horizontal slot and having an attachment means located on said strap; and said upper edge of said strap support panel is lower in height than the upper edge of the securing panel when the ladder securing device is an upright position.

2. The ladder securing device of claim 1 wherein:

said strap support panel and securing panel each extend upward from a bottom panel.

3. The ladder securing device of claim 1 wherein:

said securing panel comprises an upper edge and a bevel located on the upper edge.

4. A ladder securing device comprising:

a substantially U-shaped clip having a bottom panel, a strap support panel extending upward from a central portion of the bottom panel, a first securing panel and a second securing panel extending upward from opposing edges of the bottom panel wherein the first securing panel and the second securing panel are parallel to the strap support panel;

said strap support panel having an upper edge;

said first securing panel having an upper edge;

said second securing panel having an upper edge;

an elongated horizontal slot located on and passing through the strap support panel below the upper edge of the strap support panel and being parallel to the upper edge of the strap support panel to provide an attachment point for a strap;

said upper edge of the strap support panel being lower in height than the upper edge of the first securing panel;

said upper edge of the strap support panel being lower in height than the upper edge of the second securing panel when the ladder securing device is an upright position; and said strap looping through said elongated horizontal slot and an attachment means located on said strap.

5. The ladder securing device of claim 4 wherein:

said first securing panel comprises an upper edge and a bevel located on the upper edge.

6. The ladder securing device of claim 4 wherein:

a distance between the first securing panel and the strap support panel is less than a distance between the second securing panel and the strap support panel.

* * * * *